US009592955B2

(12) United States Patent
Baik

(10) Patent No.: US 9,592,955 B2
(45) Date of Patent: Mar. 14, 2017

(54) CONTAINER AND CONTAINER JOINT STRUCTURE

(71) Applicant: URBANTAINER CO., LTD., Seoul (KR)

(72) Inventor: Ji Won Baik, Seoul (KR)

(73) Assignee: Urbantainer Co., Ltd., Seoul (KR)

( * ) Notice: Subject to any disclaimer, the term of this patent is extended or adjusted under 35 U.S.C. 154(b) by 0 days.

(21) Appl. No.: 14/938,571

(22) Filed: Nov. 11, 2015

(65) Prior Publication Data

US 2016/0137406 A1 May 19, 2016

Related U.S. Application Data

(63) Continuation of application No. PCT/KR2014/004289, filed on May 13, 2014.

(30) Foreign Application Priority Data

May 15, 2013 (KR) ..... 10-2013-0055069

(51) Int. Cl.
*B65D 90/00* (2006.01)

(52) U.S. Cl.
CPC ..... *B65D 90/0006* (2013.01)

(58) Field of Classification Search
CPC ..... B65D 90/0006
USPC ..... 220/23.4, 23.2, 23.83, 1.5, DIG. 5
See application file for complete search history.

(56) References Cited

U.S. PATENT DOCUMENTS

| | | | | |
|---|---|---|---|---|
| 3,599,824 | A * | 8/1971 | Pneuman | B65D 90/0006 220/23.4 |
| 5,078,530 | A * | 1/1992 | Kim | E04D 3/366 403/24 |
| D334,704 | S * | 4/1993 | Andrews, Jr. | D34/1 |
| D454,692 | S * | 3/2002 | Bublitz | D3/318 |
| 6,363,586 | B1 * | 4/2002 | Neufingerl | B65D 88/005 220/1.5 |
| 6,968,839 | B2 * | 11/2005 | Lee | F24B 1/193 126/543 |
| 2004/0262308 | A1 * | 12/2004 | Hase | B65D 90/0006 220/23.4 |

FOREIGN PATENT DOCUMENTS

| | | |
|---|---|---|
| JP | 06-016178 A | 1/1994 |
| JP | 2507458 Y2 | 8/1996 |
| JP | 2000515939 A | 11/2000 |

OTHER PUBLICATIONS

International Search Report issued for Application No. PCT/KR2014/004289 dated May 28, 2014.

* cited by examiner

*Primary Examiner* — Stephen Castellano
(74) *Attorney, Agent, or Firm* — Fox Rothschild LLP

(57) ABSTRACT

A container is provided herein. The container may include a container joint structure, wherein the container joint structure may include a top side rail provided along a top edge of the container, and provided with a groove-shape having an open top; and corner castings respectively provided at end points of the top edge of the container to be in contact with both ends of the top side rail, wherein a hole may be formed at an abutment surface of each corner casting to the top side rail, and the hole may allow an internal space of the top side rail and an inside of the corner casting to communicated with each other.

16 Claims, 4 Drawing Sheets

CONTAINER AND CONTAINER JOINT STRUCTURE

CROSS-REFERENCE TO RELATED APPLICATIONS

This application is a Continuation of International Application No. PCT/KR2014/004289, filed May 13, 2014, which claims priority to Korea Patent Application No. 10-2013-0055069, filed May 15, 2013, the disclosures of which are incorporated herein by reference in their entirety.

TECHNICAL FIELD

The embodiments described herein pertain generally to a container and a container joint structure.

BACKGROUND

In general, the kinds and the specifications of shipping containers are defined by ISO (International Organization for Standardization) standard. Since containers are robust, low-priced and modularized, they are widely utilized for freight. Generally, several tens of thousands of shipping containers loaded with goods are stacked on a port. Since these shipping containers are disposed of after about ten years of usage, a tremendous amount of industrial waste is produced when the lifetime of the containers is ended.

In this regard, there has been proposed building a construction using these shipping containers. Constructions using the shipping containers are effective from the viewpoint of recycling, for the amount of the industrial waste can be reduced. Furthermore, the time and the cost for building the constructions can be efficiently saved, and, besides, these constructions are useful for donation and can be used in various ways such as being sent to third power countries for humanitarian aid or the like.

These constructions using the shipping containers can be built by connecting the shipping containers. Generally, however, if the shipping containers are connected, corner castings are protruded in certain sizes, resulting in formation of small gaps between the shipping containers. In a case of heavy rain, the gap between the containers can be flooded and remain for a long period time, resulting in corrosion of the metal containers. Alternatively, if the shipping containers are welded to prevent the rain from entering the gaps between the containers, it will be difficult to separate the containers later, as well as additional time. Further, rainwater may cause corrosion on the weld zone, and thus the problem cannot be solved fundamentally.

DISCLOSURE OF THE INVENTION

Problems to be Solved by the Invention

Example embodiments are conceived to solve the aforementioned problems and provide a container and a container joint structure capable of minimizing corrosion of a joint portion.

Means For Solving the Problems

A container is provided herein. The container may include a container joint structure, wherein the container joint structure may include a top side rail provided along a top edge of the container, and provided with a groove-shape having an open top; and corner castings respectively provided at end points of the top edge of the container to be in contact with both ends of the top side rail, wherein a hole may be formed at an abutment surface of each corner casting to the top side rail, and the hole may allow an internal space of the top side rail and an inside of the corner casting to communicated with each other.

In addition, when the container and an adjacent container which is another container adjacent to the container are arranged in parallel such that outer portions of the top side rails thereof face each other, the container joint structure further may include a cover that covers a gap formed between the facing top side rails.

A container joint structure is provided herein. The container joint structure may include a top side rail provided along a top edge of the container, and provided with a groove-shape having an open top; and corner castings respectively provided at end points of the top edge of the container to be in contact with both ends of the top side rail, wherein a hole may be formed at an abutment surface of each corner casting to the top side rail, and the hole may allow an internal space of the top side rail and an inside of the corner casting to communicated with each other.

In addition, when the container and an adjacent container which is another container adjacent to the container are arranged in parallel such that outer portions of the top side rails thereof face each other, the container joint structure further may include a cover that covers a gap formed between the facing top side rails.

Effect of the Invention

According to the example embodiments, a passage through which rainwater can flow without being collected can be formed by the top side rail, and the rainwater flowing through the top side rail can be discharged out through the hole formed at the abutment surface thereof.

Further, according to the example embodiments, when the container and the adjacent container are arranged in parallel such that the outer portions of their own top side rails face each other, the gap formed between the containers can be covered by the cover. Accordingly, raindrops can be prevented from being introduced into the gaps between the connected containers, so that corrosion of the containers can be reduced.

MODE FOR CARRYING OUT THE INVENTION

Figure 1:
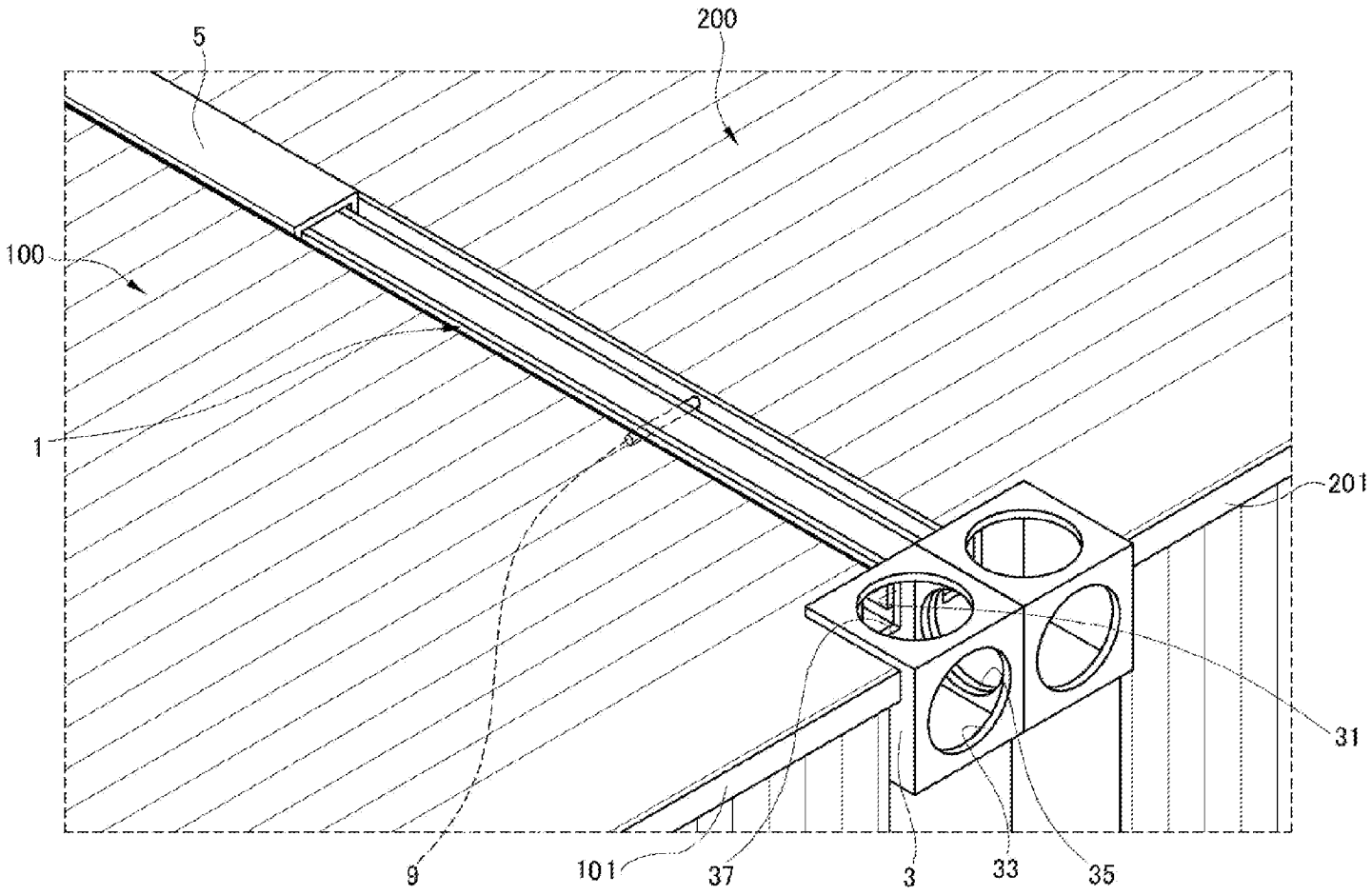
FIG. 1 depicts a schematic perspective view illustrating a part of a container to describe the container according to an example embodiment.

Hereinafter, example embodiments will be described in detail so that inventive concept may be readily implemented by those skilled in the art. However, it is to be noted that the present disclosure is not limited to the example embodiments and examples but can be realized in various other ways. In drawings, parts not directly relevant to the description are omitted to enhance the clarity of the drawings, and like reference numerals denote like parts through the whole document.

Through the whole document, the terms "connected to" or "coupled to" are used to designate a connection or coupling of one element to another element and include both a case where an element is "directly connected or coupled to" another element and a case where an element is "electronically connected or coupled to" another element via still another element.

Through the whole document, the term "on" that is used to designate a position of one element with respect to another element includes both a case that the one element is adjacent to the another element and a case that any other element exists between these two elements.

Further, through the whole document, the term "comprises or includes" and/or "comprising or including" used in the document means that one or more other components, steps, operation and/or existence or addition of elements are not excluded in addition to the described components, steps, operation and/or elements unless context dictates otherwise. The term "about or approximately" or "substantially" are intended to have meanings close to numerical values or ranges specified with an allowable error and intended to prevent accurate or absolute numerical values disclosed for understanding of the present disclosure from being illegally or unfairly used by any unconscionable third party. Through the whole document, the term "step of" does not mean "step for".

For reference, in the following description of example embodiments, terms (top side, top surface, bottom side, bottom surface, etc.) related to direction or position are defined with respect to the arrangement of individual components shown in the drawings. For example, referring to FIG. 2 to FIG. 4, a direction being oriented toward 12 o'clock overall is defined as a top side; a surface being oriented toward 12 o'clock overall, a top surface; a direction being oriented toward 6 o'clock overall, a bottom side; and a surface being oriented toward 6 o'clock, a bottom surface.

Example embodiments are directed to a container and a container joint structure.

First, a container according to an example embodiment (hereinafter, referred to as "subject container") will be described.

The subject container is a shipping container the kind and the dimension of which are specified by ISO standard. That is, the subject container may be a partially modified form of a standardized shipping container, or the subject container itself may be later authorized and manufactured as a standardized shipping container. However, it should be noted that the example embodiment is not merely limited to a standardized shipping container, but may also be applied to various types of non-standardized containers.

Figure 2:
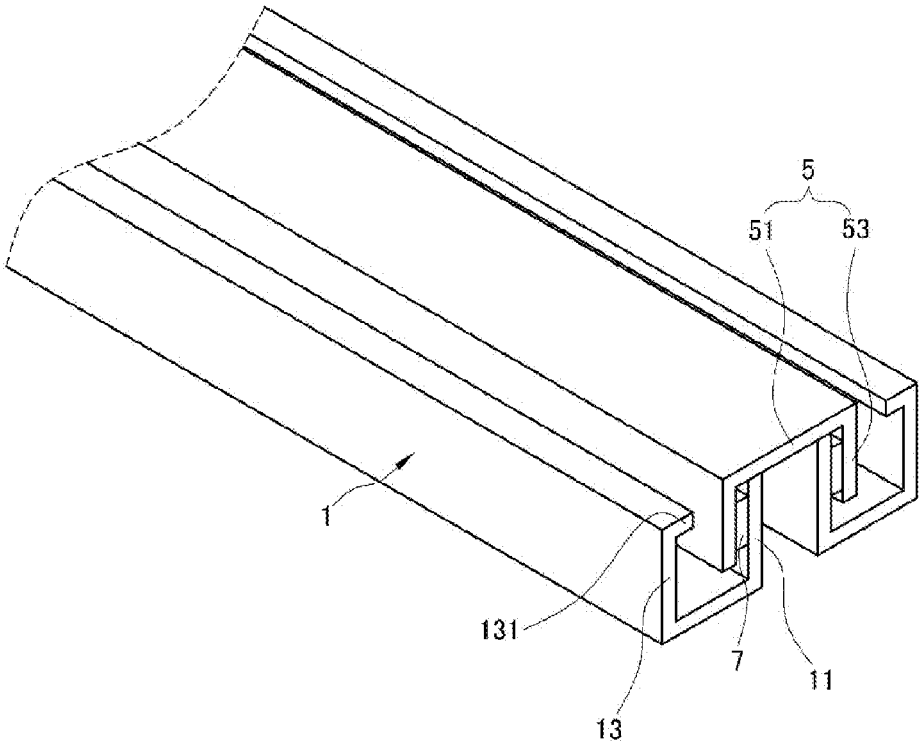
FIG. 2 provides a schematic conceptual diagram illustrating a top side rail, a cover and a sealing member to describe the container according to the example embodiment.
Figure 3A:
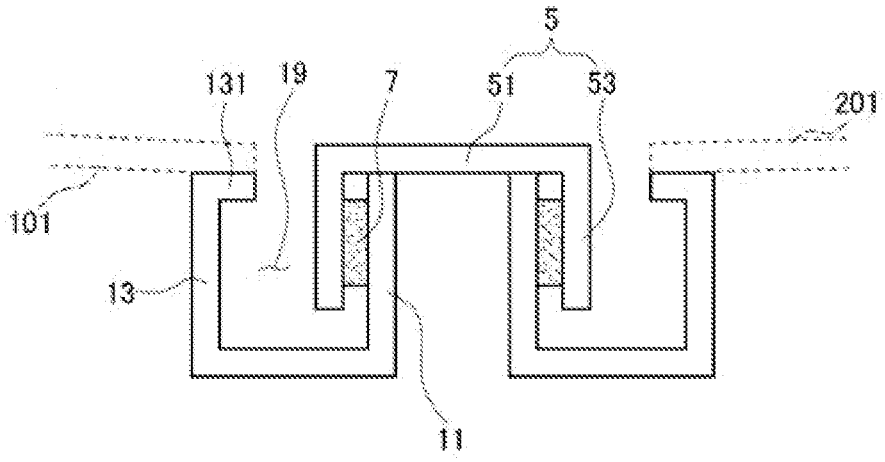
FIGS. 3A and FIG. 3B present schematic cross sectional views illustrating the top side rail, the cover and the sealing member to describe the container according to the example embodiment.
Figure 3B:
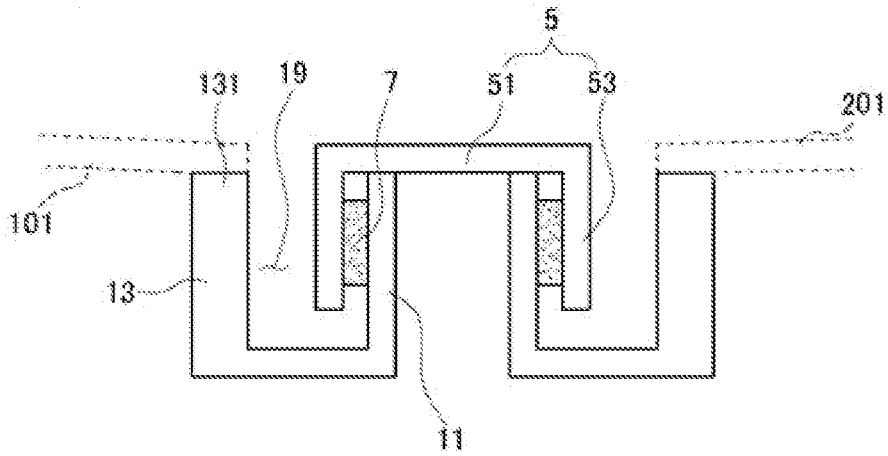

FIG. 1 provides a schematic perspective view illustrating a part of a container to describe the subject container according to the example embodiment. FIG. 2 depicts a schematic conceptual diagram illustrating a top side rail, a cover and a sealing member to describe the subject container, and FIGS. 3A and FIG. 3B present schematic cross sectional views illustrating the top side rail, the cover and the sealing member to describe the subject container. Further, FIG. 4 sets forth a schematic cross sectional view illustrating the top side rail and a corner casting to describe the subject container according to the example embodiment.

The subject container includes a container joint structure.

Referring to FIG. 1 to FIG. 3B altogether, the container joint structure is disposed at a top edge of the container 100 along a lengthwise direction thereof. The container joint structure includes a top side rail 1 having a groove-shape 19 having an open top.

For example, when the container is a shipping container, the kind and the dimension thereof are specified by ISO standard. This shipping container includes, as members corresponding to respective top edges thereof, a top end rail, a door header facing the top end rail, and two top side rails configured to connect one end of the top end rail to one end of the door header while connecting the other end of the top end rail to the other end of the door header. Further, conventionally, pipes or flat bars have been used as the top end rail, the door header and the top side rails.

A configuration of the top side rail 1 of the subject container may be applicable not only to the aforementioned conventional top side rail but also to the door header and the top end rail. That is, the top side rail 1 to be described below may be understood as a general term that collectively refers to the members corresponding to the respective top edges of the container. Accordingly, in the subject container, one or more of the conventional top end rail, door header and top side rail may be replaced by the top side rail 1 having the groove-shape with the open top.

Thus, according to the example embodiment, the top side rail 1 is an edge member provided with the groove-shape 19 having the open top. The top side rail 1 to be elaborated below may be understood as a component that replaces one or more of the conventional top end rail, door header and top side rail.

As depicted in FIG. 2 and FIG. 3A and FIG. 3B, the top side rail 1 includes an outer portion 11 and an inner portion 13.

As shown in FIG. 3A, the top side rail 1 further includes a supporting portion 131 which is extended and bent from a top end of the inner portion 13 toward the outer portion 11.

Referring to FIG. 1 and FIG. 3A, a distal end of a roof portion 101 of the container 100 is sustained on the supporting portion 131.

As another example embodiment, referring to FIG. 3B, the top side rail 1 may not be provided with the supporting portion 131. Instead, the inner portion 13 of the top side rail 13 itself may have an enough thickness to stably support the distal end of the roof portion 101 of the container 100 thereon.

Furthermore, referring to FIG. 1, the container joint structure further includes corner castings 3 disposed at two opposite end points of the top edge to be in contact with both ends of the top side rails 1, respectively.

Figure 4:
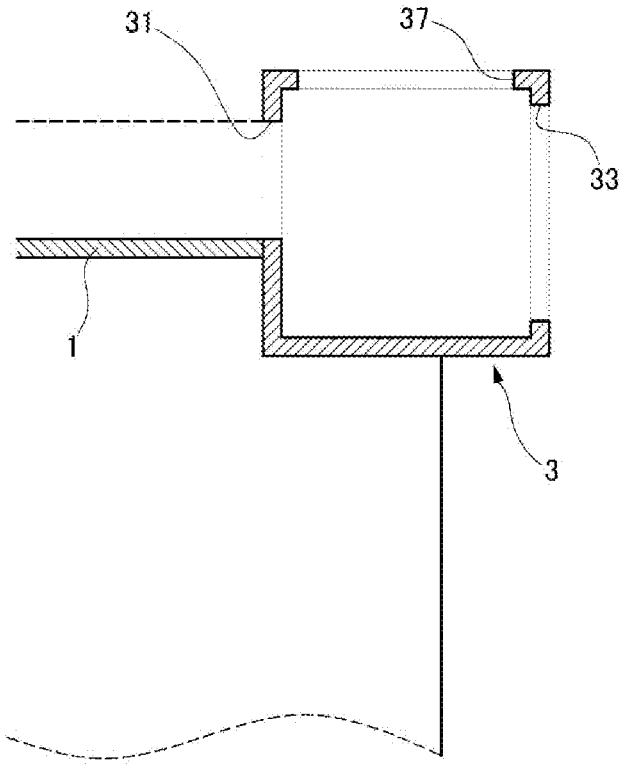
FIG. 4 offers a schematic cross sectional view illustrating the top side rail and a corner casting to describe the container according to the example embodiment.

As illustrated in FIG. 1 and FIG. 4, each corner casting 3 in contact with the top side rail 1 is provided with, at its abutment surface to the top side rail 1, a hole 31 through which the inside of the corner casting 3 communicates with the internal space 19 of the top side rail 19.

Accordingly, a fluid within the internal space 19 can be introduced into the corner casting 3 through the hole 31. By way of example, when it rails, raindrops falling down into the internal space 19 of the top side rail 1 may be flown within and along the top side rail 1 and introduced into the corner casing 3 through the hole 31.

Referring back to FIG. 1, the corner casting 3 may be provided with a hole 33 at a side surface thereof exposed to the outside.

Here, referring to FIG. 1 and FIG. 4, the term "side surface" means a surface of the corner casting 3 except a top surface and a bottom surface thereof. For example, the hole 33 formed at the side surface exposed to the outside may be formed at a surface of the corner casting 3 opposite from the abutment surface where the hole 31 for allowing the internal space 19 and the inside of the corner casting 3 to communicate with each other is provided.

The fluid introduced into the corner casting 3 through the hole 33 formed at the side surface exposed to the outside may be discharged to the outside. For instance, the rainwater flown into the corner casting 3 may be drained to the outside through the hole 33 formed at the side surface exposed to the outside.

Moreover, as illustrated in FIG. 1 and FIG. 4, a hole 37 may be formed at the top surface of the corner casting 3. By way of example, the container 100 and a container moving crane for moving the container 100 can be connected through the hole 37 formed at the top surface of the corner casting and either one of the hole 33 and a hole 35 which are formed at the side surfaces of the corner casting 3, respectively.

In addition, as shown in FIG. 4, the corner casting 3 may be configured to be protruded above the container higher than the top side rail 1.

With this configuration, the roof portion 101 of the container 100 is given a preset gradient toward the top side rail 1, as depicted in FIG. 3A. Accordingly, raindrops or the like on the roof portion 101 may be collected into the top side rail 1.

By way of non-limiting example, when another container is stacked on top of the container 100 shown in FIG. 1, the corner casting 3 of the container 100 and a corner casting of another container are also stacked while being in contact with each other. In this regard, the preset gradient is set to allow the raindrops on the roof portion 101 of the container to be collected into the top side rail 1 within a range where the corner castings can be stacked in contact with each other.

Moreover, referring to FIG. 1 and FIG. 2, when the container 100 and an adjacent container 200 are arranged in parallel so that outer portions 11 of their own top side rails 1 face each other, the container joint structure may include a cover 5 that covers a gap formed between the mutually facing top side rails 1.

With this configuration, inflow of a fluid into the gap between the top side rails can be suppressed.

As an example, referring to FIG. 1, raindrops can be prevented from falling into a gap between the container 100 and the adjacent container 200 when it rains.

Meanwhile, as shown in FIG. 1, the corner casting 3 may be configured to be protruded in a sidewise direction more than the top side rail 1. Accordingly, a gap is formed in the state that the corner casting 3 of the container 100 and the corner casting 3 of the adjacent container 200 are in contact with each other.

Here, referring to FIG. 1, the term "sidewise direction" may refer to a direction oriented toward the corner casting 3 of the facing container 200. Accordingly, as illustrated in FIG. 1, the corner casting 3 of the container 100 and the corner casting 3 of the adjacent container 200 can be brought into contact with each other. Further, a gap may not be formed between the corner castings 3 which are in contact with each other, but may be formed between the outer portions 11 of the facing top side rails 1 of the two adjacent containers 100 and 200.

As depicted in FIG. 2, FIG. 3A and FIG. 3B, the cover 5 includes a top surface 51 that covers the gap between the top side rails; and sidewalls 53 provided to face inner surfaces of the outer portions 11 of the facing top side rails 1, respectively.

By way of non-limiting example, the cover 5 may be a member whose a cross section is a bottom-side-opened rectangular shape.

Furthermore, as shown in FIG. 3A and FIG. 3B, the container joint structure may further include a sealing member 7 provided along the lengthwise direction of the top edge of the container to seal a clearance between each sidewall 53 of the cover 5 and the inner surface of the outer portion 11 of each corresponding top side rail 1. Here, the inner sidewall 53 and the inner surface of the outer portion 11 of the top side rail 1 face each other.

The sealing member 7 suppresses the fluid within the internal space 19 of the top side rail 1 from being introduced into the gap between the adjacent top side rails through the clearance between the sidewall 53 and the inner surface of the outer portion 11. The sealing member 7 may be implemented by, but not limited to, a gasket.

In addition, referring to FIG. 1, the corner casting 3 may be provided with a hole 35 at a side surface thereof which is in contact with the corner casting 3 of the adjacent container 200. Through this hole 35, the corner casting 3 of the container 100 is allowed to communicate with the corner casting of the adjacent container 200.

Accordingly, when the fluid is flown too much into either one of the corner casting 3 of the container 100 and the corner casting 3 of the container 200 in a non-uniform manner, the fluid in the one corner casting 3 may be moved into the other corner casting 3 and drained out. Thus, stagnation in the draining of the fluid can be prevented more efficiently.

Meanwhile, though not shown in the drawings, the top side rails 1 disposed to face each other with the gap therebetween can be connected by the cover 5.

For example, referring to FIG. 3A and FIG. 3B, the two sidewalls 53 of the cover 5 are engaged with the outer portions 11 of the top side rails 1 of the containers 100 and 200, respectively, so that the facing top side rails 1 are connected to each other by the cover 5. At this time, as shown in FIG. 3A and FIG. 3B, in case that the sealing members 7 are provided, the sidewalls 53 of the cover 5 and the outer portions 11 of the adjacent top side rails 1 may be connected by bolting or the like while being spaced apart from each other at an interval as much as occupied by the sealing member 7.

Moreover, referring to FIG. 1, the facing top side rails 1 may be coupled to each other with the gap therebetween.

As stated above, this gap is formed as the corner castings are protruded in the sidewise direction. Accordingly, the top side rails 1 are generally connected while being spaced apart from each other as much as the size of the gap. Though this connection between the top side rails may be accomplished by means of the cover 5, as stated above, the top side rails may also be connected to each other by a fastening pin 9, as illustrated in FIG. 1. By way of non-limiting example, the fastening pin 9 may be a bolt. Therefore, according to the example embodiment, the top portions of the container 100 and the adjacent container 200 can be firmly connected to each other.

Conventionally, since two containers are connected by direct welding therebetween, it has been difficult to reuse the containers. According the example embodiment, however, the subject container can be connected to another container in a simple way through the use of the cover 5 or the fastening pin 9. Furthermore, since the gap between the containers is closed by the cover 5, it is also possible to achieve the effect of preventing raindrops from being collected in the gap between the containers. Here, however, it should be noted that the present disclosure does not exclude the conventional way of connecting the containers by welding. For example, the sidewall 53 of the cover 5 and the outer portion 11 of the top side rail 11 may be connected by welding without a space provided therebetween.

Furthermore, since the container joint structure is manufactured by being modularized, the subject container can be assembled and manufactured more simply and rapidly by using the modularized container joint structure.

Further, the subject container can be embodied by applying the container joint structure to a conventional container. Here, the conventional container means a container produced according to the ISO standard. For example, the conventional container may be a shipping container. That is, the subject container may adopt a structure of the conventional standardized shipping container by partially modifying it. Further, the subject container itself is expected to be authorized and manufactured as a standardized shipping container in the future.

As stated above, since the subject container uses an internationally standardized container, for example, a shipping container, cost can be cut greatly. Furthermore, since the subject container has efficient constituent parts and organic linkage therebetween, a troublesome process such as welding is not necessary to cover a gap which is formed between conventional containers when the containers are connected by using the conventional corner casting protruded outwards (except in upward and downward directions).

The container joint structure (hereinafter, referred to as "subject container joint structure") included in the container according to the above-described example embodiment will be elaborated in accordance with an example embodiment. Here, however, the same or similar parts as described above will be assigned same reference numerals, and redundant description thereof will be simplified or omitted.

Referring to FIG. 1, the subject container joint structure includes a top side rail 1 disposed at a top edge of the container 100 along a lengthwise direction thereof. The top side rail 1 is provided with a groove-shape 19 having an open top.

As depicted in FIG. 3A, the top side rail 1 includes a supporting portion 131 which is bent and extended from a top end of the inner portion 13 of the top side rail 1 toward the outer portion 11 thereof.

Further, referring to FIG. 3B, the inner portion 13 of the top side rail 1 may have a preset thickness.

Moreover, referring to FIG. 1, the subject container joint structure further includes corner castings 3 provided at two opposite end points of the top edge of the container to be in contact with both ends of the top side rails 1.

Here, a hole 31 1 for allowing the internal space 19 and the inside of the corner casting 3 to communicate with each other is formed at an abutment surface of the corner casing 3 to the top side rail 1.

Furthermore, referring to FIG. 1 and FIG. 2, the container joint structure may further include a cover 5 configured to cover a gap formed between the top side rail 1 of the container 100 and a top side rail of an adjacent container 200 when these two containers are arranged in parallel so that outer portions 11 of their own top side rails 1 face each other.

The cover 5 includes a top surface 51 that covers the gap; and sidewalls 53 disposed to face inner surfaces of the outer portions 11 of the two facing top side rails 1, respectively.

Further, referring to FIG. 3A and FIG. 3B, the subject container joint structure may further include a sealing member 7 provided along the lengthwise direction of the top edge of the container so as to seal a clearance between each sidewall 53 of the cover 5 and the inner surface of the outer portion 11 of each corresponding top side rail 1. Here, the inner sidewall 53 and the inner surface of the outer portion 11 of the top side rail 1 face each other.

Moreover, the subject container joint structure can be applied to a conventional container. The conventional container can be produced into a building or a construction easily by using the subject container joint structure, and the building or the construction can be built at low cost with high efficiency, and corrosion thereof can be minimized. Meanwhile, the conventional container may be a container manufactured according to ISO standard. For example, the conventional container may be a shipping container.

The above description of the example embodiments is provided for the purpose of illustration, and it would be understood by those skilled in the art that various changes and modifications may be made without changing technical conception and essential features of the example embodiments. Thus, it is clear that the above-described example embodiments are illustrative in all aspects and do not limit the present disclosure. For example, each component described to be of a single type can be implemented in a distributed manner. Likewise, components described to be distributed can be implemented in a combined manner.

The scope of the inventive concept is defined by the following claims and their equivalents rather than by the detailed description of the illustrative embodiments. It shall be understood that all modifications and embodiments conceived from the meaning and scope of the claims and their equivalents are included in the scope of the inventive concept.

I claim:

1. A container, comprising:

a container joint structure, wherein the container joint structure comprising:

a top side rail provided along a top edge of the container, and provided with a groove-shape having an open top; and corner castings respectively provided at end points of the top edge of the container to be in contact with both ends of the top side rail, wherein a hole is formed at an abutment surface of each corner casting to the top side rail, and the hole allows an internal space of the top side rail and an inside of the corner casting to communicated with each other.

2. The container of claim 1, wherein when the container and an adjacent container which is another container adjacent to the container are arranged in parallel such that outer portions of the top side rails thereof face each other, the container joint structure further comprises a cover that covers a gap formed between the facing top side rails.

3. The container of claim 2, wherein the top side rails provided to face each other with the gap therebetween are connected by the cover.

4. The container of claim 2, wherein the corner casting is protruded in a sidewise direction of the container more than the top side rail, and the gap is formed in the state where the corner casting of the container and a corner casting of the adjacent container are in contact with each other.

5. The container of claim 4, wherein the corner casting has a hole formed at a surface thereof in contact with the corner casting of the adjacent container, and the hole allows the corner casting of the container to communicate with the corner casting of the adjacent container.

6. The container of claim 1, wherein the corner casting has a hole formed at a side surface thereof exposed to the outside.

7. The container of claim 1, wherein the corner casting is protruded above the container higher than the top side rail.

8. The container of claim 2, wherein the cover comprises a top surface configured to cover the gap, and sidewalls provided to face inner surfaces of the outer portions of the facing top side rails, respectively.

9. The container of claim 8, wherein the container joint structure further comprises:

a sealing member provided along the top edge to seal a clearance between each sidewall of the cover and the inner surface of the outer portion of each corresponding top side rail which are arranged to face each other.

10. The container of claim 9, wherein the top side rail comprises a supporting portion extended and bent from a top end of an inner portion of the top side rail toward the outer portion thereof.

11. The container of claim 1, wherein when the container and an adjacent container which is another container adjacent to the container are arranged in parallel such that outer portions of the top side rails thereof face each other, the facing top side rails are connected to each other with a gap therebetween.

12. A container joint structure, comprising:

a top side rail provided along a top edge of the container, and provided with a groove-shape having an open top; and corner castings respectively provided at end points of the top edge of the container to be in contact with both ends of the top side rail, wherein a hole is formed at an abutment surface of each corner casting to the top side rail, and the hole allows an internal space of the top side rail and an inside of the corner casting to communicated with each other.

13. The container joint structure of claim 12, wherein when the container and another container adjacent to the container (hereinafter, referred to as "adjacent container") are arranged in parallel such that outer portions of the top side rails thereof face each other, the container joint structure further comprises a cover that covers a gap formed between the facing top side rails.

14. The container joint structure of claim 13, wherein the cover comprises a top surface configured to cover the gap, and sidewalls provided to face inner surfaces of the outer portions of the facing top side rails, respectively.

15. The container joint structure of claim 14, wherein the container joint structure further comprises:

a sealing member provided along the top edge to seal a clearance between each sidewall of the cover and the inner surface of the outer portion of each corresponding top side rail which are arranged to face each other.

16. The container joint structure of claim 15, wherein the top side rail comprises a supporting portion extended and bent from a top end of an inner portion of the top side rail toward the outer portion thereof.

* * * * *